US011096547B1

(12) United States Patent
Zhu et al.

(10) Patent No.: US 11,096,547 B1
(45) Date of Patent: Aug. 24, 2021

(54) WATER DISCHARGE CONTROL STRUCTURE OF WASHING BUCKET CAPABLE OF SEPARATING CLEAN WATER FROM DIRTY WATER FOR WASHING CLEANING TOOL

(71) Applicant: JIANGSU ZHOU JIJIE INTELLIGENT TECHNOLOGY CO., LTD., Suqian (CN)

(72) Inventors: Chenhui Zhu, Suqian (CN); Juhong Zhang, Suqian (CN)

(73) Assignee: JIANGSU ZHOU JIJIE INTELLIGENT TECHNOLOGY CO., LTD., Suqian (CN)

( * ) Notice: Subject to any disclaimer, the term of this patent is extended or adjusted under 35 U.S.C. 154(b) by 0 days.

(21) Appl. No.: 17/266,646

(22) PCT Filed: May 22, 2019

(86) PCT No.: PCT/CN2019/087980
§ 371 (c)(1),
(2) Date: Feb. 8, 2021

(87) PCT Pub. No.: WO2020/038027
PCT Pub. Date: Feb. 27, 2020

(30) Foreign Application Priority Data

Aug. 24, 2018 (CN) ..... 201821379338.2

(51) Int. Cl.
*A47L 13/58* (2006.01)

(52) U.S. Cl.
CPC ..... *A47L 13/58* (2013.01)

(58) Field of Classification Search
CPC ..... A47L 13/58
See application file for complete search history.

(56) References Cited

U.S. PATENT DOCUMENTS

2018/0028040 A1* 2/2018 Delangue ..... A47L 13/60
2019/0216287 A1* 7/2019 Zhu ..... A47L 13/58

FOREIGN PATENT DOCUMENTS

| | | | |
|---|---|---|---|
| CN | 203354500 | U | 12/2013 |
| CN | 203619505 | U | 6/2014 |
| CN | 204541999 | U | 8/2015 |
| CN | 107049189 | A | 8/2017 |
| CN | 107811591 | A | 3/2018 |
| KR | 20170055405 | A | 5/2017 |

* cited by examiner

*Primary Examiner* — Weilun Lo
(74) *Attorney, Agent, or Firm* — Bayramoglu Law Offices LLC

(57) ABSTRACT

A water discharge control structure of a washing bucket capable of separating clean water from dirty water for washing a cleaning tool includes: a washing bucket body and a water storage tank, wherein the washing bucket body is internally provided with a lifting frame fitted with the cleaning tool, and the lifting frame is driven by the cleaning tool to be lifted and lowered relative to the washing bucket body; the water storage tank is connected to the washing bucket body and has a water outlet directing to the cleaning tool, a discharge of water of the water outlet is controlled by a plug, and when the lifting frame is in a high position, the lifting frame drives the plug to block the water outlet; and when the lifting frame is in a low position, the lifting frame drives the plug in a linked manner to open the water outlet.

11 Claims, 7 Drawing Sheets

WATER DISCHARGE CONTROL STRUCTURE OF WASHING BUCKET CAPABLE OF SEPARATING CLEAN WATER FROM DIRTY WATER FOR WASHING CLEANING TOOL

CROSS REFERENCE TO THE RELATED APPLICATIONS

This application is the national stage entry of International Application No. PCT/CN2019/087980, filed on May 22, 2019, which is based upon and claims priority to Chinese Patent Application No. 201821379338.2, filed on Aug. 24, 2018, the entire contents of which are incorporated herein by reference.

TECHNICAL FIELD

The invention belongs to the technical field of cleaning tools, and particularly relates to a water discharge control structure of a washing bucket capable of separating clean water from dirty water for washing a cleaning tool.

BACKGROUND

At present, cleaning tools such as mops are generally washed in a washing bucket. Common mop washing buckets typically have a cleaning function and a spin-drying function and structurally comprise a bucket body and a spin-drying drum, wherein a support frame is coaxially pivoted to the spin-drying drum and can move upwards or downwards along the inner wall of the drum, so when the spin-drying cylinder is lifted along with the support frame, a mop head placed in the spin-drying drum is above the water level in the bucket body and thus can be spin-dried; when the spin-drying drum moves downwards along with the support frame, the mop head in the spin-drying drum is below the water level in the bucket body and thus can be cleaned. However, the mop cleaning effect of the cleaning bucket body is usually unsatisfying for the following reasons: 1, the mop cannot be fully unfolded when cleaned and spin-dried, and the spin-drying drum may block part of dirt adhered to the mop; 2, when the mop is cleaned in the washing bucket body, cleaning water will become dirty, which means that the mop is actually soaked and washed in dirty water in the mop bucket, and clean water cannot be separated from dirty water, so that the cleaning effect is poor; 3, the existing washing bucket body does not have a water storage and supply function, and water needs to be poured into the bucket in advance and has to be changed frequently to improve the cleaning effect, so that operation is inconvenient.

To solve the problems of the prior art, people have put forward different solutions after long-term research. For example, Chinese Patent Application No. 201420680098.5 discloses a lifting mop washing bucket with a central shaft, and a mop, wherein the lifting mop washing bucket comprises a bucket body, and a central shaft is connected to the bottom of the interior of the bucket body and comprises a fixed shaft, a lifting shaft, a rail for connecting the fixed shaft with the lifting shaft, and a limiting bump matched with the rail; the rail comprises a bottom slot and an upper slot which are connected by means of a connecting groove; a rotary shaft accommodating part is arranged at the top of the lifting shaft, a bottom shaft sleeve is arranged at the bottom of the rotary shaft accommodating part, a top shaft sleeve is arranged the top of the rotary shaft accommodating part and is sleeved with a rotary shaft, and the rotary shaft has a bottom end abutting the bottom of the bottom shaft sleeve and a top to be fixedly connected to the mop.

In this solution, a washing basket is eliminated, so that the mop is made, to some extent, to fully contact with water when washed, However, this solution still fails to separate clean water from dirty water during washing, the mop is actually washed still in dirty water, and the cleaning effect still remains unsatisfying; in addition, the washing bucket body does not have a water storage and supply function, so that operation is inconvenient.

SUMMARY

The objective of the invention is to solve the above-mentioned problems by providing a discharge control structure of a washing bucket capable of separating clean water from dirty water for washing a cleaning tool.

To fulfill the aforesaid objective, the invention adopts the following technical solution: a discharge control structure of a washing bucket capable of separating clean water from dirty water for washing a cleaning tool is arranged in a in a washing bucket body which is internally provided with a lifting frame fitted with a cleaning tool, and the lifting frame is driven by the cleaning tool to be lifted and lowered relative to the washing bucket body, wherein the water discharge control structure comprises a water storage tank connected to the washing bucket body, the water storage tank has a water outlet directing to the cleaning tool, and discharge of water of the water outlet is controlled by a plug; when the lifting frame is in a high position, the lifting frame drives the plug in a linked manner to block the water outlet; and when the lifting frame is in a low position, the lifting frame drives the plug in a linked manner to open the water outlet to allow water to flow to the cleaning tool from the water outlet.

According to the discharge control structure of a washing bucket capable of separating clean water from dirty water for washing a cleaning tool, at least one scrubbing base is arranged in the washing bucket body, the water outlets are sequentially formed in an upper side of the scrubbing base, an inflow passage extending in an axial direction and communicated with the water outlets is formed in the scrubbing base, a discharge joint is arranged at a lower end of the water storage tank, a discharge passage communicated with the inflow passage is formed in the discharge joint, the plug is arranged between the discharge passage and the inflow passage, an elastic ejection structure connected to one end of the plug is arranged in the discharge joint, and a plug ejection assembly enabling the plug to move in the axial direction when the lifting frame is vertically lifted and lowered is arranged between the other end of the plug and the lifting frame.

According to the discharge control structure of a washing bucket capable of separating clean water from dirty water for washing a cleaning tool, the plug ejection assembly comprises an ejection rod extending in an axial direction of the discharge passage, the ejection rod has one end connected to the plug and the other slidably penetrating through the end of the scrubbing base to extend out of the scrubbing base, an ejection head having an outer side provided with an arc ejection face is arranged at the end, located outside the scrubbing base, of the ejection rod, an ejection base corresponding to the ejection head is arranged on the lifting frame, and an ejection slope fitted with the arc ejection face is arranged on the ejection base.

According to the discharge control structure of a washing bucket capable of separating clean water from dirty water for washing a cleaning tool, the elastic ejection structure comprises an ejection spring arranged between the plug and the discharge joint, and the ejection spring has one end abutting against the plug and the other end acting on the discharge joint.

According to the discharge control structure of a washing bucket capable of separating clean water from dirty water for washing a cleaning tool, the scrubbing bases are circumferentially and regularly distributed with the central axis of the lifting frame as a center and are each of a strip shape, two parallel rows of bristles are sequentially arranged on the upper side of each scrubbing base, and the water outlets are sequentially and regularly arranged between the two rows of bristles in the axial direction.

According to the discharge control structure of a washing bucket capable of separating clean water from dirty water for washing a cleaning tool, the water storage tank is detachably arranged in the washing bucket body, a circumferential outer side of the water storage tank is fitted with a circumferential inner side of the washing bucket body, a washing cavity is formed in a circumferential inner side of the water storage tank, and a handle structure and a water filling nozzle are arranged on the water storage tank.

According to the discharge control structure of a washing bucket capable of separating clean water from dirty water for washing a cleaning tool, the scrubbing bases are fixedly arranged on the circumferential inner side of the water storage tank; or, the scrubbing bases are integrated with the water storage tank.

According to the discharge control structure of a washing bucket capable of separating clean water from dirty water for washing a cleaning tool, the lifting frame comprises a lifting column, a connector detachably connected to the cleaning tool is arranged at a top of the lifting column, the ejection base is arranged at an upper end of the lifting column and is located below the connector, and a lifting pedestal is arranged at a lower end of the lifting column.

According to the discharge control structure of a washing bucket capable of separating clean water from dirty water for washing a cleaning tool, a hollow rail seat is arranged at a bottom of the washing bucket body, the lifting pedestal is rotatably arranged in the rail seat, and the lifting pedestal and the rail seat are connected through a lifting rail assembly.

According to the discharge control structure of a washing bucket capable of separating clean water from dirty water for washing a cleaning tool, the lifting rail assembly comprises a lifting rail arranged on a circumferential inner side of the rail seat, the lifting rail is distributed circumferentially, high rail positions and low rail positions are sequentially and alternately arranged in the lifting rail, and a plurality of lifting shafts extending into the lifting rail are arranged on a circumferential outer side of the lifting pedestal in a radial direction.

Compared with the prior art, the discharge control structure of a washing bucket capable of separating clean water from dirty water for washing a cleaning tool has the following advantages:

1. Clean water can be discharged from the water outlet by means of manual lifting of a mop, so that clean water is separated from dirty water during washing, clean water is always used for washing, and the cleaning effect is good; in addition, dirt adhered to the mop can be removed during washing by means of bristles, so that a wiping effect is realized.

2. The discharge control structure has a water storage and supply function, water can be added into the water storage tank conveniently, water supplied at one time can be used for multiple times of washing, operation is easy, and frequent water changes for improving the washing effect is not needed.

Figure 1:
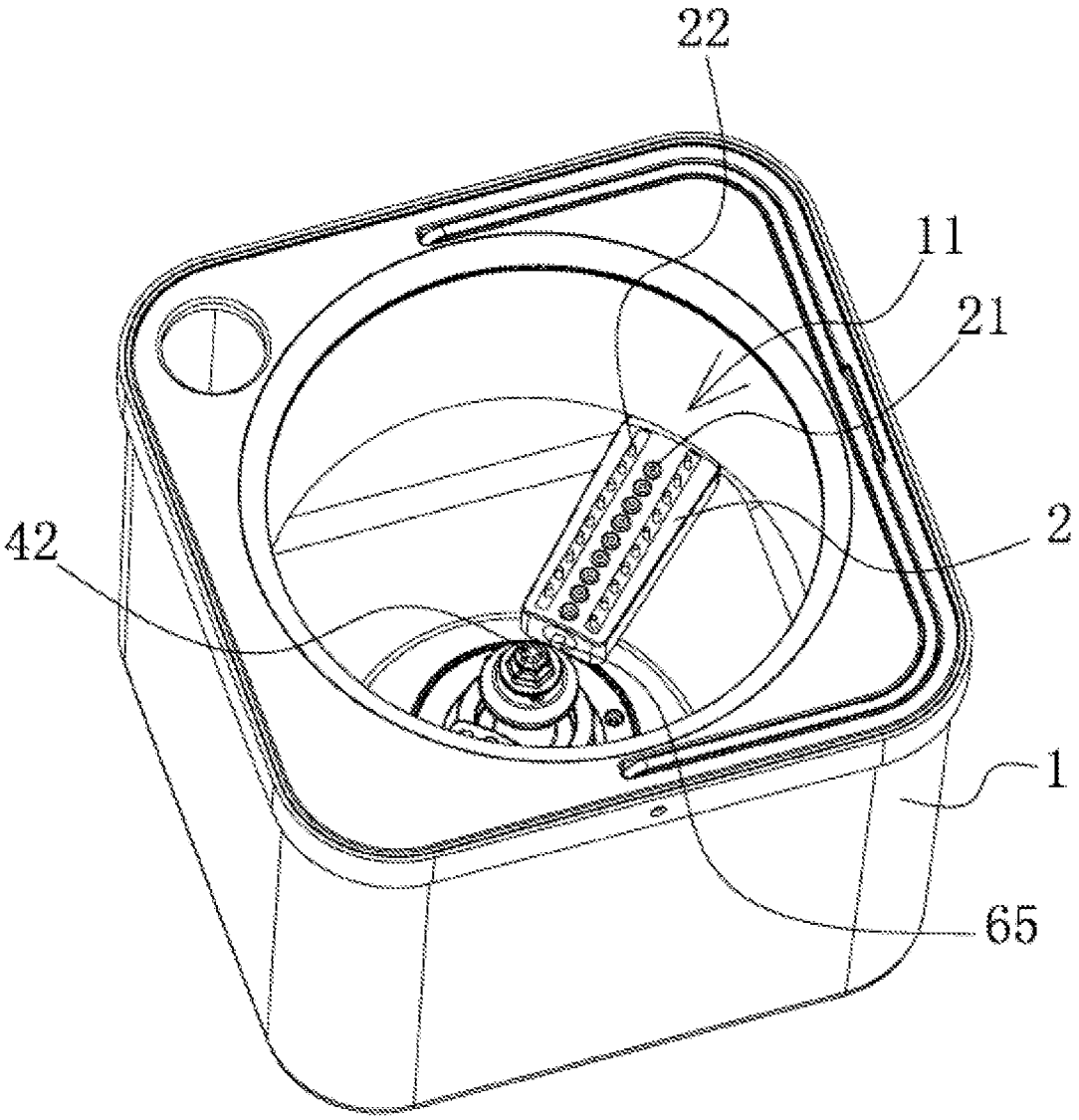
FIG. 1 is a structural view of a washing bucket body according to the invention.
Figure 2:
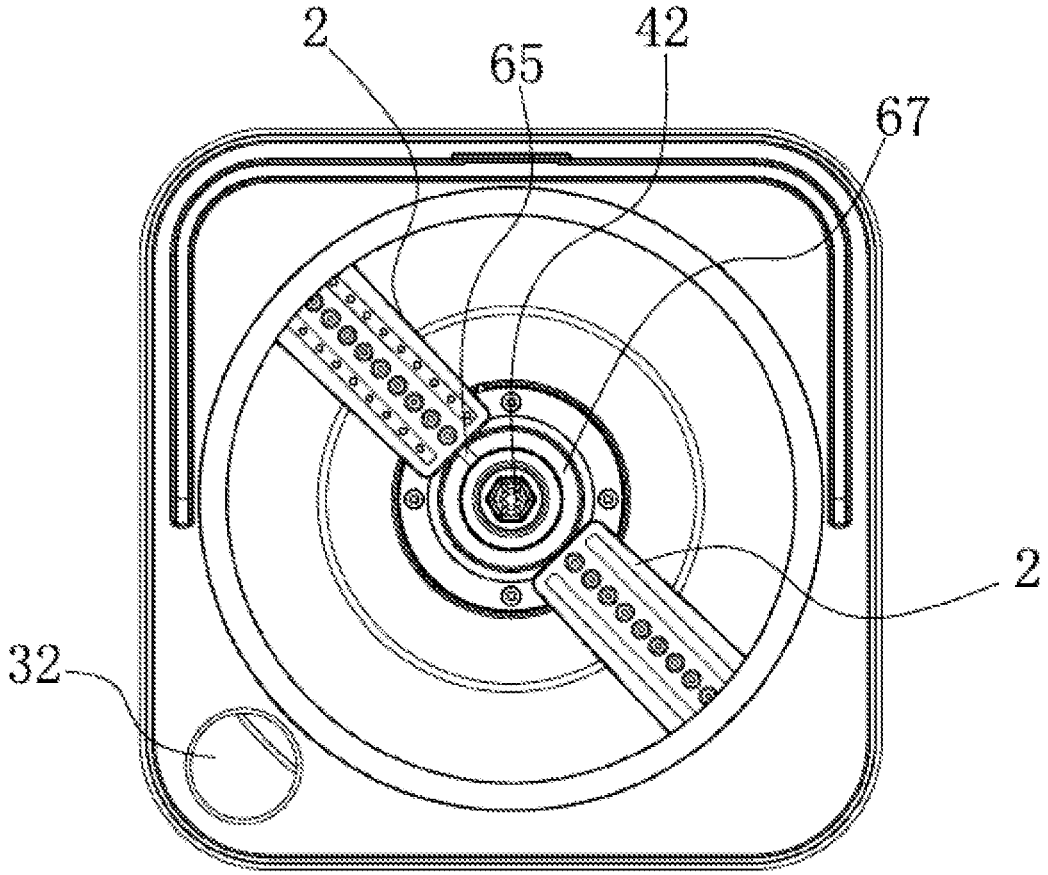
FIG. 2 is a structural view of the washing bucket body from another perspective according to the invention.
Figure 3:
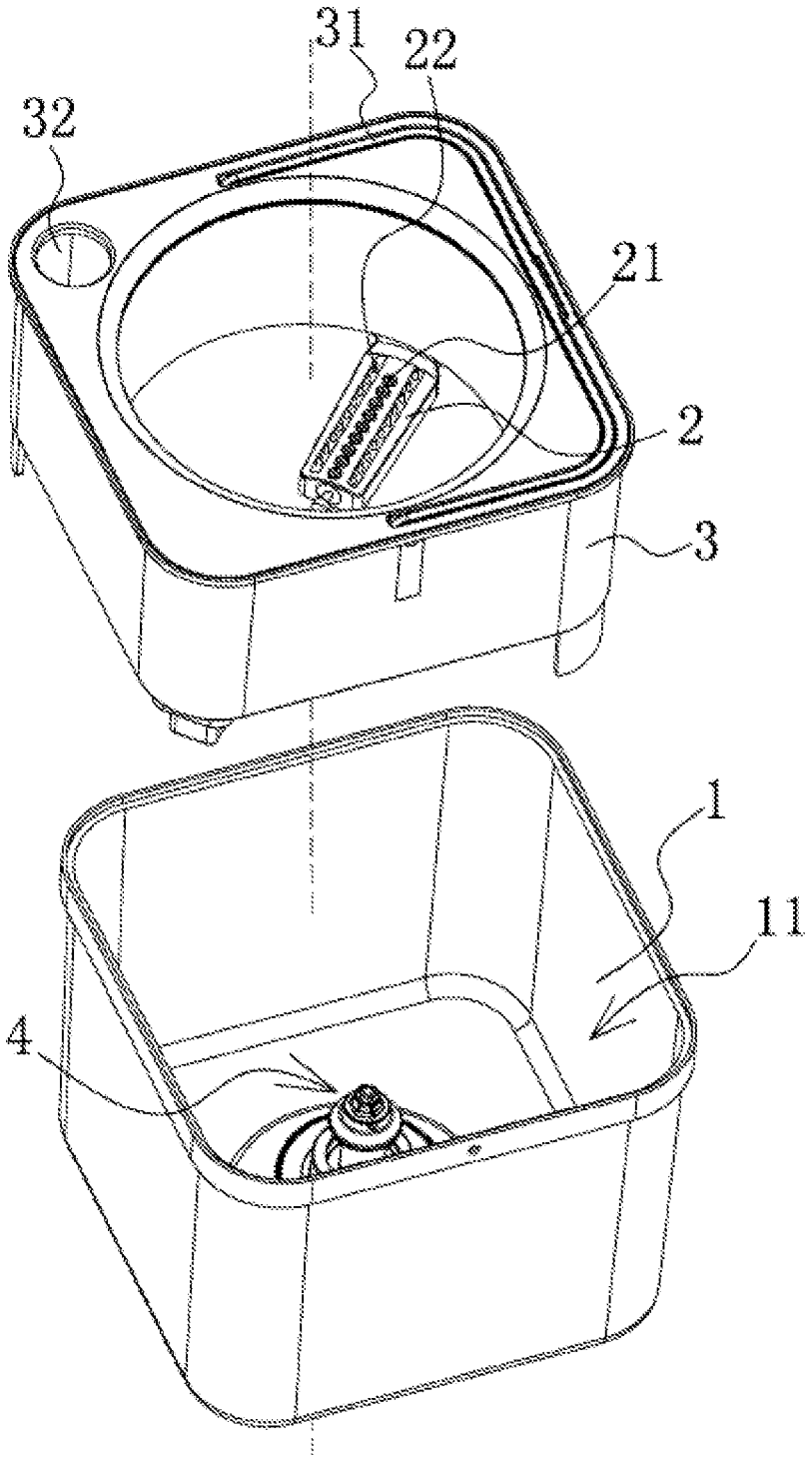
FIG. 3 is an exploded structural view of the washing bucket body according to the invention.

In the figures: 1, washing bucket body; 11, washing cavity; 12, rail seat; 2, scrubbing base; 21, water outlet; 22, bristle; 3, water storage tank; 31, handle structure; 32, water filling nozzle; 4, lifting frame; 41, lifting column; 42, connector; 43, lifting pedestal; 5, lifting rail assembly; 51, lifting rail; 52, high rail position; 53, low rail position; 54, lifting shaft; 6, plug ejection assembly; 61, inflow passage; 62, discharge joint; 63, discharge passage; 64, plug; 65, ejection rod; 66, ejection head; 661, arc ejection face; 67, ejection base; 671, ejection slope; 68, ejection spring; 7, mop.

DETAILED DESCRIPTION OF THE EMBODIMENTS

The invention will be explained in further detail below in conjunction with the accompanying drawings and specific implementations.

As shown in FIG. 1-FIG. 6, a water discharge control structure of a washing bucket capable of separating clean water from dirty water for washing a cleaning tool is arranged on a cleaning bucket body 1, wherein the cleaning bucket body 1 is internally provided with a washing cavity 11 and a lifting frame 4 fitted with a cleaning tool, and the lifting frame 4 is driven by the cleaning tool to be lifted and lowered relative to the washing bucket body 1, the lifting frame 4 comprises a lifting column 41, and a connector 42 detachably connected to the cleaning tool is arranged at the top of the lifting column 41, for example, the connector 42 is detachably connected to a mop 7; when the mop 7 is manually lifted or lowered, the lifting frame 4 can ascend and descend synchronously along with the mop 7; a lifting pedestal 43 is arranged at the lower end of the lifting column 41, a hollow rail seat 12 is arranged at the bottom of the cleaning bucket body 1, the lifting pedestal 43 is rotatably arranged in the rail seat 12, the lifting pedestal 43 is rotatably arranged in the rail seat 12, and a lifting rail assembly 5 is arranged between the lifting pedestal 43 and the rail seat 12. The water discharge control structure further comprises a water storage tank 3 connected to the washing bucket body 1, wherein the water storage tank 3 has a water outlet 21 directing to the cleaning tool, and the discharge of water of the water outlet 21 is controlled by a plug 64; when the lifting frame 4 is in a high position, the lifting frame 4 drives the plug 64 in a linked manner to block the water outlet 21; when the lifting frame 4 is in a low position, the lifting frame 4 drives the plug 64 in a linked manner to open the water outlet 21 to allow water to flow to the cleaning tool from the water outlet 21.

Furthermore, at least one scrubbing base 2 is arranged in the washing bucket body 1. Preferably, the scrubbing bases 2 are suspended in the washing bucket body 1, a gap is formed between the scrubbing bases 2 and the bottom of the washing bucket body 1 and is used for storing dirty water, the water outlets 21 are sequentially formed in upper sides of the scrubbing bases 2, the scrubbing bases 2 are circumferentially and regularly distributed with the center axis of the lifting frame 4 as the center and are each of a strip shape, two parallel rows of bristles 22 are sequentially arranged on the upper side of each scrubbing base 2, and the water outlets 21 are sequentially and regularly distributed between the two rows of bristles 22 in an axial direction. Wherein, an inflow passage 61 which extends in the axial direction and is communicated with the water outlet 21 is formed in the scrubbing base 2, a discharge joint 62 is arranged at the lower end of the water storage tank 3, a discharge passage 63 communicated with the inflow passage 61 is formed in the discharge joint 62, the plug 64 is arranged between the discharge passage 63 and the inflow passage 61, an elastic ejection structure connected to one end of the plug 64 is arranged in the discharge joint 62, and a plug ejection assembly 6 enabling the plug 64 to move in the axial direction, when the lifting frame is vertically lifted or lowered, is arranged between the other end of the plug 64 and the lifting frame 4.

When the mop 7 is manually lifted or lowered, the lifting frame 4 can ascend or descend synchronously along with the mop 7 through the lifting rail assembly 5 to enable the water outlet 21 and the water storage tank 3 to be communicated or not communicated. That is, when the mop 7 is lowered, the lifting frame 4 is forced to descend, clean water flows out from the water outlet 21 to wash the mop 7, and dirt water directly flows downward into the gap between the scrubbing base 2 and the washing bucket body 1 after cleaning, so that clean water is separated from dirty water. When the mop 7 is lifted, the lifting frame 4 ascends synchronously, water is stopped from flowing out from the water outlet 21, and at this moment, the mop 7 is rotated and contacts with the bristles 22 to be spin-dried after being washed.

Furthermore, the plug ejection assembly 6 comprises an inflow passage 61 which extends in the scrubbing base 2 in an axial direction and is communicated with the water outlet 21, a discharge joint 62 is arranged at the lower end of the water storage tank 3, a discharge passage 63 communicated with the inflow passage 61 is arranged in the discharge joint 62, and the plug 64 is movably arranged between the discharge passage 63 and the inflow passage 61. Preferably, the plug 64 is arranged at the end of the discharge passage 63 and moves along the discharge passage 63 to be opened or closed, and an elastic ejection structure connected to one end of the plug 64 is arranged in the discharge joint 62. Preferably, the elastic ejection structure comprises an ejection spring 68 arranged between the plug 64 and the discharge joint 62, and the ejection spring 68 has one end abutting against the plug 64 and the other end acting on the discharge joint 62, that is to say, the plug 64 is pressed against the discharge passage 63 by means of the ejection spring 68, so that it is ensured that the plug 64 is closed in a normal state. A plug ejection assembly 6 enabling the plug 64 to move in the axial direction when the lifting frame 4 is vertically lifted and lowered is arranged between the other end of the plug 64 and the lifting frame 4.

Preferably, the plug ejection assembly 6 comprise an ejection rod 65 which extends in an axial direction of the discharge passage 63, wherein one end of the ejection rod 65 is connected to the plug 64, the other end of the ejection rod 65 slidably penetrates through the end of the scrubbing base 2 to extend out of the scrubbing base 2, an ejection head 66 having an outer side provided with an arc ejection face 661 is arranged at the end, located outside the scrubbing base 2, of the ejection rod 65, the lifting frame 4 is provided with an ejection base 67 corresponding to the ejection head 66, the ejection base 67 is arranged at the upper end of the lifting column 41 and is located below the connector 42, and an ejection slope 671 fitted with the arc ejection face 661 is arranged on the ejection base 67.

Furthermore, the water storage tank 3 is detachably arranged in the washing bucket body 1, a circumferential outer side of the water storage tank 3 is fitted with a circumferential outer side of the washing bucket body 1, the washing cavity 11 is formed in the circumferential inner side of the water storage tank 3, and a handle structure 31 and a water filling nozzle 32 are arranged on the water storage tank 3. Wherein, the scrubbing base 2 is fixedly arranged on the circumferential inner side of the water storage tank 3; or, the scrubbing base 2 is integrated with the water storage tank 3.

As shown in FIG. 4 and FIG. 6-FIG. 8, the lifting rail assembly 5 comprises a lifting rail 51 arranged on a circumferential inner side of the rail seat 12, the lifting rail 51 is distributed in a circumferential direction, high rail positions 52 and low rail positions 53 are sequentially and alternately arranged in the lifting rail 51, and a plurality of lifting shafts 54 extending into the lifting rail 51 are arranged on a circumferential outer side of the lifting pedestal 43 in a radial direction.

Figure 4:
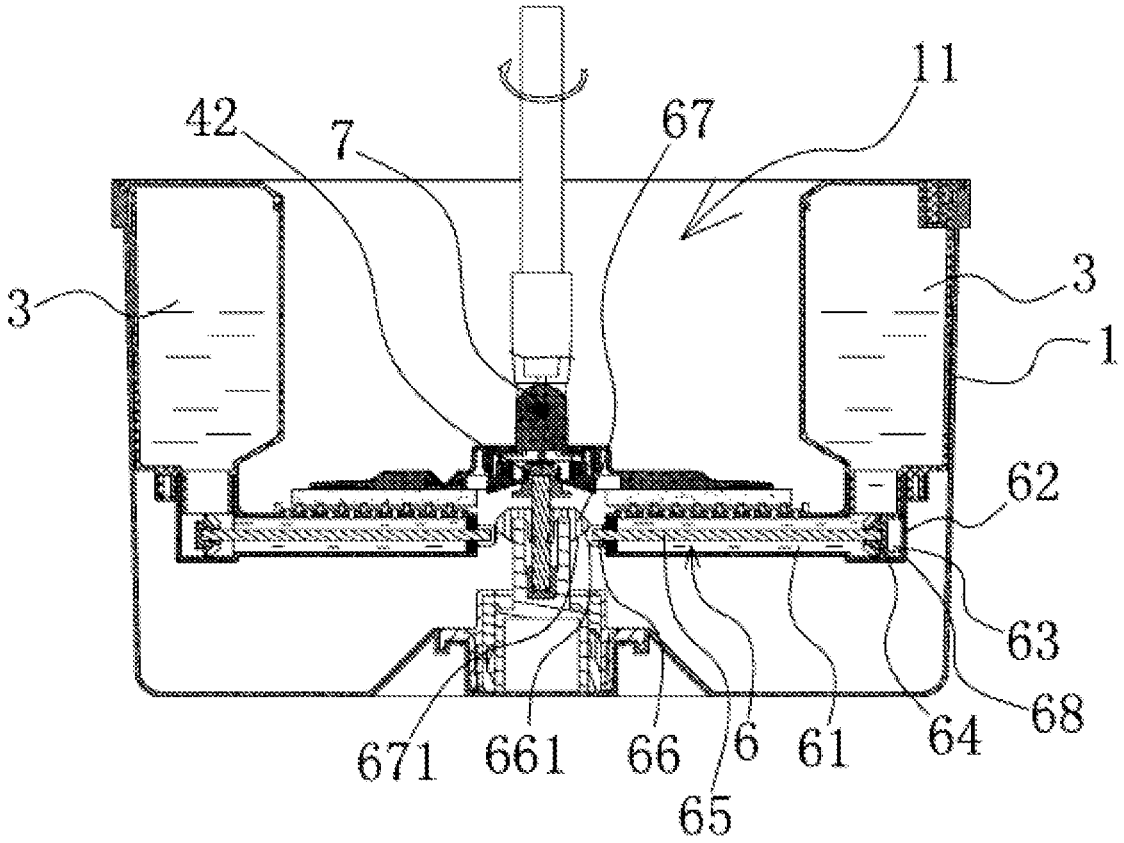
FIG. 4 is a sectional view of the washing bucket body in a cleaning state according to the invention.
Figure 5:
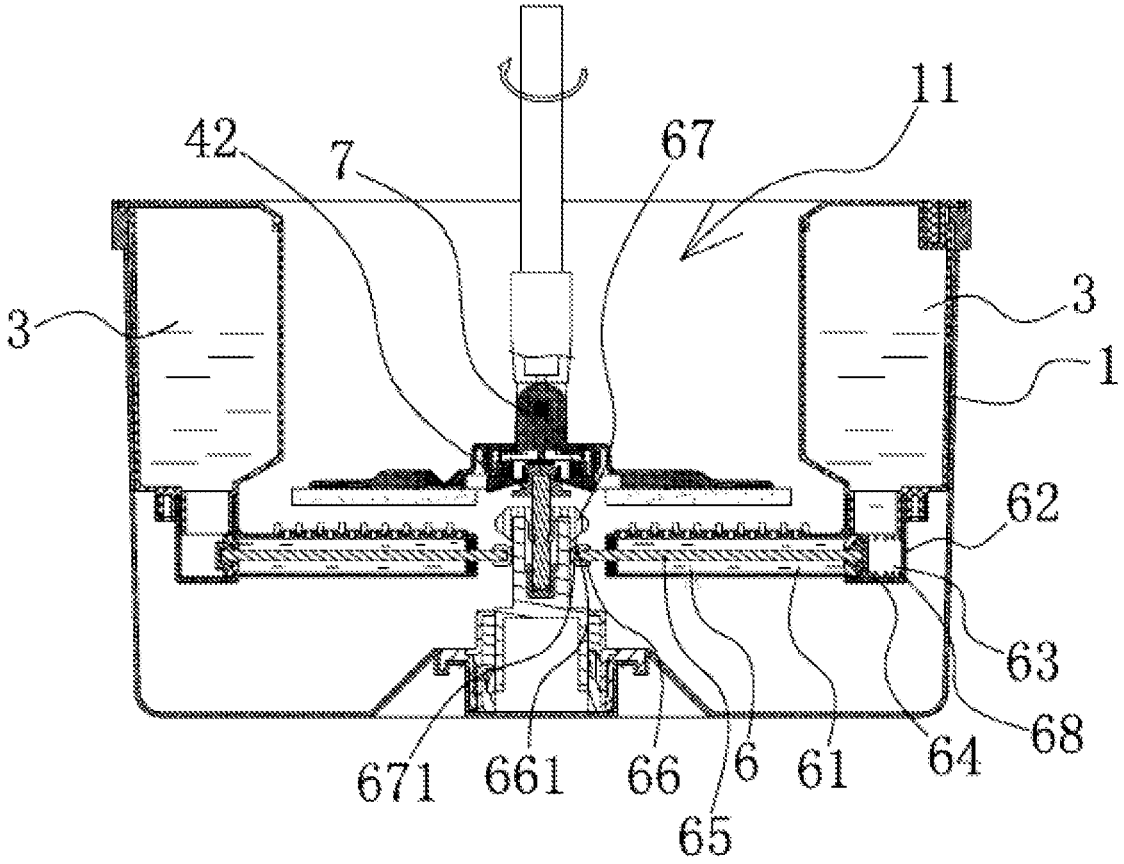
FIG. 5 is a sectional view of the washing bucket body in a state where water is completely discharged out of the washing bucket body according to the invention.
Figure 6:
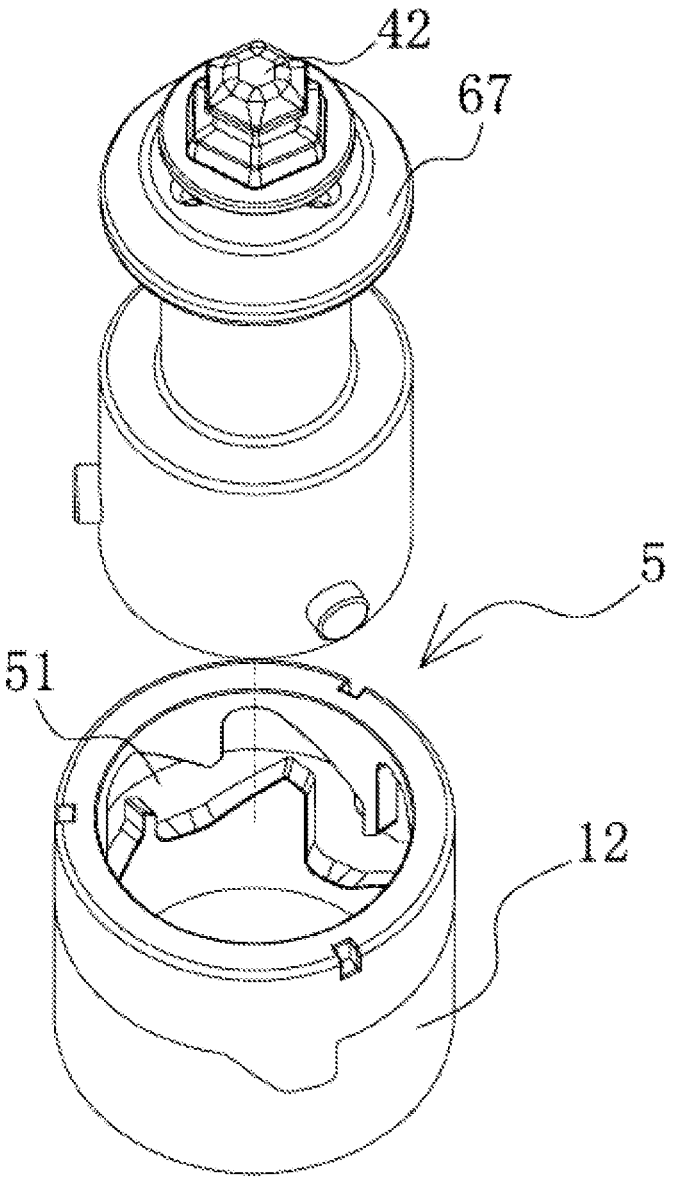
FIG. 6 is an exploded structural view of a lifting drive mechanism according to the invention.
Figure 7:
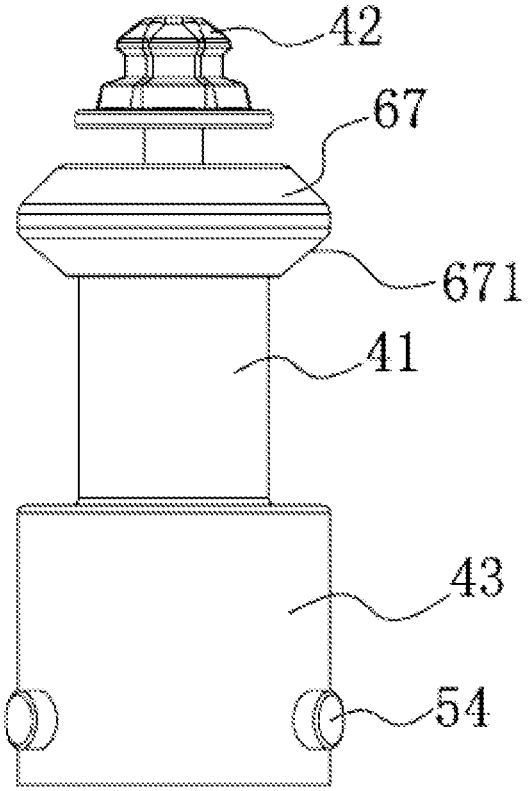
FIG. 7 is a structural view of a lifting frame according to the invention.
Figure 8:
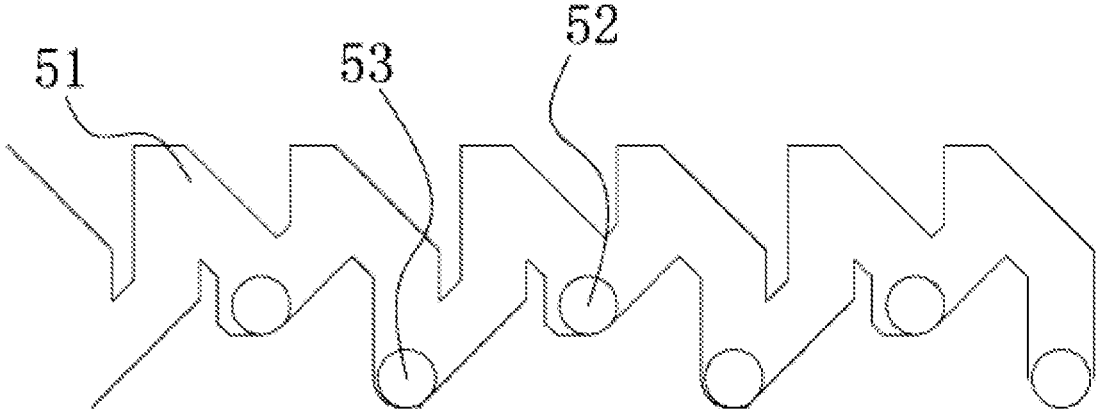
FIG. 8 is a distribution diagram of a lifting rail according to the invention.

The principle of this embodiment is as follows: referring to FIG. 4, when the mop 7 is manually pressed downwards, the connector 42 moves downwards along with the mop 7, the ejection base 67 moves downwards to eject the ejection head 66 to enable the ejection rod 65 to move in the axial direction, the plug 64 overcomes the elastic force of the ejection spring 68 and then moves along with the ejection rod 65, the water outlet 21 is communicated with the water storage tank 3, clean water flows out from the water outlet 21 to wash the mop 7, and dirty water directly flows downwards into the gap between the scrubbing base 2 and the washing bucket body 1 after cleaning, so that the clean water is separated from the dirty water; referring to FIG. 5, when the mop 7 is manually pulled upwards, the connector 42 moves upwards along with the mop 7, the ejection base 67 is separated from the ejection base 66, the plug 64 is closed under the effect of the elastic force of the ejection spring 68, water is stopped from flowing out from the water outlet 21, and at this moment, the mop 7 is rotated and contacts with the bristles 22 to be spin-dried after being washed.

The specific embodiments described in this specification are merely used to explain the spirit of the invention by way of examples. Those skilled in the art can make different modifications, supplements or similar substitutions to these specific embodiments without departing from the spirit of the invention or exceeding the scope defined by the appended claims.

Although the terms such as "washing bucket body 1", "washing cavity 11", "rail seat 12", "scrubbing base 2", "water outlet 21", "bristle 22", "water storage tank 3", "handle structure 31", "water filling nozzle 32", "lifting frame 4", "lifting column 41", "connector 42", "lifting pedestal 43", "lifting rail assembly 5", "lifting rail 51", "high rail position 52", "low rail position 53", "lifting shaft 54", "plug ejection assembly 6", "inflow passage 61", "discharge joint 62", "discharge passage 63", "plug 64", "ejection rod 65", "ejection head 66", "arc ejection face 661", "ejection base 67", "ejection slope 671", "ejection spring 68" and "mop 7" are frequently used in the specification, other terms probably used. All these terms are used merely for the purpose of describing and explaining the concept of the invention more easily, and any interpretations of these terms as additional limitations go against the spirit of the invention.

What is claimed is:

1. A water discharge control structure of a washing bucket capable of separating clean water from dirty water for washing a cleaning tool, wherein the water discharge control structure is arranged in a washing bucket body, the washing bucket body is internally provided with a lifting frame fitted with the cleaning tool, the lifting frame is driven by the cleaning tool to be lifted and lowered relative to the washing bucket body, the water discharge control structure comprises a water storage tank connected to the washing bucket body, wherein the water storage tank has water outlets directing to the cleaning tool, and a discharge of water of the water outlets is controlled by a plug;

when the lifting frame is in a high position, the lifting frame drives the plug in a linked manner to block the water outlets; and when the lifting frame is in a low position, the lifting frame drives the plug in the linked manner to open the water outlets to allow water to flow to the cleaning tool from the water outlets.

2. The water discharge control structure according to claim 1, wherein at least one scrubbing base is arranged in the washing bucket body, the water outlets are sequentially formed in an upper side of the at least one scrubbing base, an inflow passage extending in an axial direction and communicated with the water outlets is formed in the at least one scrubbing base, a discharge joint is arranged at a lower end of the water storage tank, a discharge passage communicated with the inflow passage is formed in the discharge joint, the plug is arranged between the discharge passage and the inflow passage, an elastic ejection structure connected to a first end of the plug is arranged in the discharge joint, and a plug ejection assembly enabling the plug to move in the axial direction when the lifting frame is vertically lifted and lowered is arranged between a second end of the plug and the lifting frame.

3. The water discharge control structure according to claim 2, wherein the plug ejection assembly comprises an ejection rod extending in an axial direction of the discharge passage, wherein the ejection rod has a first end connected to the plug and a second end slidably penetrating through an end of the at least one scrubbing base to extend out of the at least one scrubbing base, an ejection head having an outer side provided with an arc ejection face is arranged at the second end, located outside the at least one scrubbing base, of the ejection rod, an ejection base corresponding to the ejection head is arranged on the lifting frame, and an ejection slope fitted with the arc ejection face is arranged on the ejection base.

4. The water discharge control structure according to claim 2, wherein the elastic ejection structure comprises an ejection spring arranged between the plug and the discharge joint, and the ejection spring has a first end abutting against the plug and a second end acting on the discharge joint.

5. The water discharge control structure according to claim 2, wherein the at least one scrubbing base is circumferentially and regularly distributed with a central axis of the lifting frame as a center, the at least one scrubbing base is in a strip shape, two parallel rows of bristles are sequentially arranged on the upper side of the at least one scrubbing base, and the water outlets are sequentially and regularly arranged between the two parallel rows of bristles in the axial direction.

6. The water discharge control structure according to claim 5, wherein the water storage tank is detachably arranged in the washing bucket body, a circumferential outer side of the water storage tank is fitted with a circumferential inner side of the washing bucket body, a washing cavity is formed in a circumferential inner side of the water storage tank, and a handle structure and a water filling nozzle are arranged on the water storage tank.

7. The water discharge control structure according to claim 6, wherein the at least one scrubbing base is fixedly arranged on the circumferential inner side of the water storage tank; or the at least one scrubbing base is integrated with the water storage tank.

8. The water discharge control structure according to claim 3, wherein the lifting frame comprises a lifting column, wherein a connector detachably connected to the cleaning tool is arranged at a top of the lifting column, the ejection base is arranged at an upper end of the lifting column and is located below the connector, and a lifting pedestal is arranged at a lower end of the lifting column.

9. The water discharge control structure according to claim 8, wherein a hollow rail seat is arranged at a bottom of the washing bucket body, the lifting pedestal is rotatably arranged in the hollow rail seat, and the lifting pedestal and the hollow rail seat are connected through a lifting rail assembly.

10. The water discharge control structure according to claim 9, wherein the lifting rail assembly comprises a lifting rail arranged on a circumferential inner side of the hollow rail seat, wherein the lifting rail is distributed in a circumferential direction, high rail positions and low rail positions are sequentially and alternately arranged in the lifting rail, and a plurality of lifting shafts extending into the lifting rail are arranged on a circumferential outer side of the lifting pedestal in a radial direction.

11. The water discharge control structure according to claim 3, wherein the elastic ejection structure comprises an ejection spring arranged between the plug and the discharge joint, and the ejection spring has a first end abutting against the plug and a second end acting on the discharge joint.

* * * * *